United States Patent [19]

Grant

[11] Patent Number: 4,750,652

[45] Date of Patent: Jun. 14, 1988

[54] SHOULDER HOLSTER

[76] Inventor: Richard W. Grant, 2405 California St., Berkeley, Calif. 94703

[21] Appl. No.: 899,462

[22] Filed: Aug. 22, 1986

[51] Int. Cl.[4] ..... A45C 15/00

[52] U.S. Cl. ..... 224/151; 224/206

[58] Field of Search ..... 2/230; 224/205, 206, 224/911, 192, 209, 240, 202, 243, 259, 238, 914

[56] References Cited

U.S. PATENT DOCUMENTS

| | | | |
|---|---|---|---|
| D. 106,869 | 11/1937 | Miller | 224/259 X |
| D. 234,840 | 4/1975 | Adams | 224/911 X |
| 297,268 | 4/1884 | Kepley . | |
| 892,446 | 7/1908 | Payne | 2/230 |
| 1,252,221 | 1/1918 | Berman | 2/230 |
| 1,517,588 | 12/1924 | Sasaki | 224/914 X |
| 1,884,328 | 10/1928 | Sperling . | |
| 2,037,132 | 4/1936 | Hoyt . | |
| 2,396,118 | 3/1946 | Ohlmeyer . | |
| 3,074,250 | 1/1968 | Everett . | |
| 3,152,738 | 10/1964 | Worsfold, Jr. | 224/259 |
| 3,664,560 | 5/1972 | Perkins . | |
| 3,739,961 | 6/1973 | Soukeras | 224/151 |
| 4,068,784 | 1/1978 | Angell | 224/911 X |
| 4,084,734 | 4/1978 | Bianchi et al. | 224/192 |
| 4,303,185 | 12/1981 | Shoemaker | 224/911 X |
| 4,346,827 | 8/1982 | Bianchi et al. . | |
| 4,463,884 | 8/1984 | Parlante | 224/911 X |

*Primary Examiner*—James E. Bryant, III
*Assistant Examiner*—Robert M. Petrik
*Attorney, Agent, or Firm*—Townsend and Townsend

[57] ABSTRACT

A reversible shoulder holster for carrying firearms includes a sheath which can be worn on either side. The sheath supports the weapon in a vertical position and with the butt vertically below the barrel. A back piece spaces apart and directs a first and second pair of straps such that they emanate from the back piece in an X-shape. The first and second pairs of the straps are removably connected to either a sheath or an accessory carrier. The sheath includes at least one open end and incorporates a spring clip which engages the weapon, such as at the ejector port of a semiautomatic handgun, to secure the weapon in the sheath. The tension of the spring clip may be adjusted by a tension screw passing through the sheath. The X-shape of the harness straps provides for a greater freedom of movement for the wearer. The removable straps allow for easy adjustment. The removability of the straps and the reversibility of the sheath and accessory holder allow the shoulder hoster to be used by either a left or righthanded wearer.

11 Claims, 1 Drawing Sheet

SHOULDER HOLSTER

The present invention relates to a reversible shoulder holster for pistols, revolvers and the like.

BACKGROUND OF THE INVENTION

Law enforcement officers and other professionals wear concealable underarm holsters to carry weapons such as handguns. Typically, shoulder holsters employ a single shoulder strap supporting a sheath under one arm. Since the majority of handgun users are right-handed, the majority of these shoulder holsters are designed for the righthanded user. A lefthanded shoulder holster must be specially manufactured.

Most shoulder holsters are constructed from leather straps. The wearing of such shoulder holsters for long periods of time can cause discomfort, especially during certain movements of the arms or while running. Also, such shoulder holsters are not usually easily adjustable to the size of the wearer.

Most shoulder holsters hold the gun with the barrel of the gun vertically downward so the butt of the gun extends upwardly. This positioning of the gun makes it somewhat difficult to draw from the holster. Since the butt end of the handgun is much thicker than the barrel, the upward orientation of the butt produces a tell-tale bulge in the jacket or upper body clothing of the wearer.

SUMMARY OF THE INVENTION

In view of the state of the art, I have analyzed the existing shoulder holsters, found the difficulties noted above, and have determined the solutions.

I have designed a reversible shoulder holster especially suited for use with automatic pistols. The shoulder holster includes a pair of harness straps, each defining an armhole. The straps are in the form of a loop with the outer ends of each fastened to a connection member. The connection member is positioned at the center of the user's back and is configured so that the straps form an X-shaped arrangement. A sheath, shaped to house at least a portion of the weapon, is suspended from one of the harness straps so that it lies below the wearer's shoulder. The sheath is suspended from the harness strap such that at least a portion of an open end of the sheath is disposed downwardly. The sheath can be secured to either harness strap according to whether the user is right or lefthanded. The firearm is clipped in the sheath in a generally vertical, upside-down position for convenient access and removal by the user. A U-shaped spring clip which wraps around the slide of the pistol biases the handgun securely in the sheath. In the preferred embodiment, at least one of the free ends of the spring clip snaps into the ejector port of the pistol.

BRIEF DESCRIPTION OF THE FIGURES

This invention may be more clearly understood from the following detailed description and by reference to the drawings in which.

DETAILED DESCRIPTION OF THE INVENTION

Figure 1:
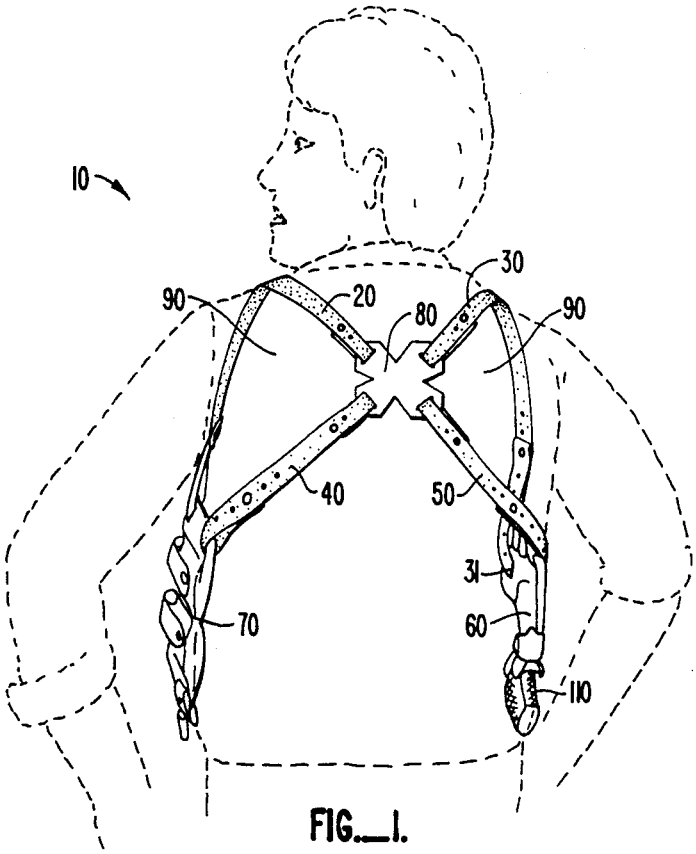
FIG. 1 is a rear view of the shoulder holster as worn.

Shoulder holster 10 includes a series of harness straps 20, 30, 40, 50 which suspend a sheath 60 and an accessory carrier 70 on opposite sides of the wearer's body. As can be best seen in FIG. 1, the arrangement of the straps is determined by the back piece 80 which is centered along the wearer's back. The straps 20, 30, 40 and 50 emanate from the back piece 80 in an X-shape, defining two very large armholes 90 through which the wearer's arms extend.

It has been found that narrow leather or sueded leather straps are the most comfortable and durable materials of construction. The unique design of the shoulder holster disclosed herein eliminates the necessity for any elasticized members which can bind the wearer and which are easily worn out. The sheath 60 and accessory carrier 70 are also preferably formed from molded and punched leather. The sheath 60 may be configured to carry any model handgun which has an ejection port safely, or even other weapons if desired. The accessory carrier 70 can be configured to carry appropriate ammunition magazines or "clips", and can include quick-release handcuff straps or a strap for suspending a nightstick of the type sometimes employed by law enforcement officers. Both the sheath 60 and accessory carrier 70 are constructed so as to attach to either straps 20 and 40, or 30 and 50 to be properly oriented when attached to either side of the shoulder holster 10.

The back piece 80 can also conveniently be formed from leather. The back piece 80 determines the overall configuration of the shoulder holster 10 by arranging straps 20, 30, 40 and 50 into an X-shaped arrangement when viewed from the wearer's back which provides a first pair of straps (30, 50) for suspending the sheath 60 and a second pair of straps (20, 40) for suspending the accessory carrier 70 or vice-versa.

The cross-arrangement of straps permits a wide range of body movements by the wearer. The straps are supportive without binding the wearer since the armholes 90 created by the pairs of straps are very large and do not laterally connect one side of the body to the other. That is, straps 20, 30, 40 & 50 are all at substantial angles to the horizontal so the shoulders and arm sockets of the wearer are completely unrestrained by the pairs of straps.

Figure 1A:
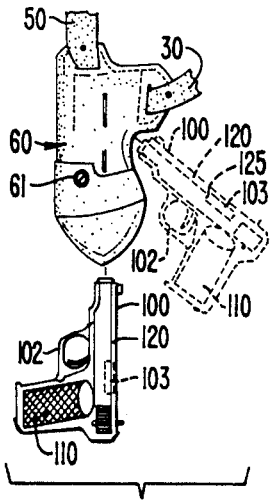
FIG. 1A is a view showing a handgun as it is inserted in the sheath.

The sheath 60 is suspended from the first pair of straps (30, 50) such that a pistol 120 placed within the sheath is held generally upside-down and vertically, with the butt 110 of the gun vertically below the barrel 100 of the gun. See FIG. 1A. This arrangement permits the wearer to draw the gun, with the hand from the opposite side of the body, by comfortably grasping the butt 110 and grip 101 and pulling the gun up and out slightly and then downwardly from the sheath 60. The trigger guard of the pistol is covered by sheath 60 as a safety precaution.

Figure 2:
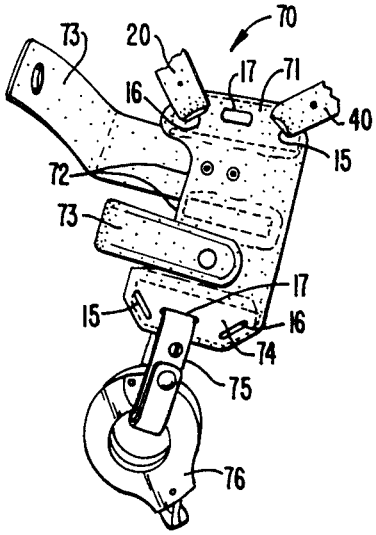
FIG. 2 is a profile view of an accessory carrier.

FIG. 2 is a detailed view of an exemplary accessory carrier 70. It is suspended from the straps 20, 40 through openings 15, 16 formed at its upper end 71. Two ammunition pockets 72 are formed out of molded and stitched leather with snapped cover flaps 73 to secure the clips. At a lower end 74, a quick release thumb strap 75, passing through opening 17 in carrier 70, secures handcuffs for ready access. The accessory carrier may be designed to carry loaded magazines or ammunition clips and various accessories such as a dagger. To provide for proper orientation along either side of the shoulder holster, both ends 71, 74 of the accessory carrier have openings 15, 16 and 17 formed therein so that it can be reversed from the left side to the right side of the weapon carrier.

Figure 3:
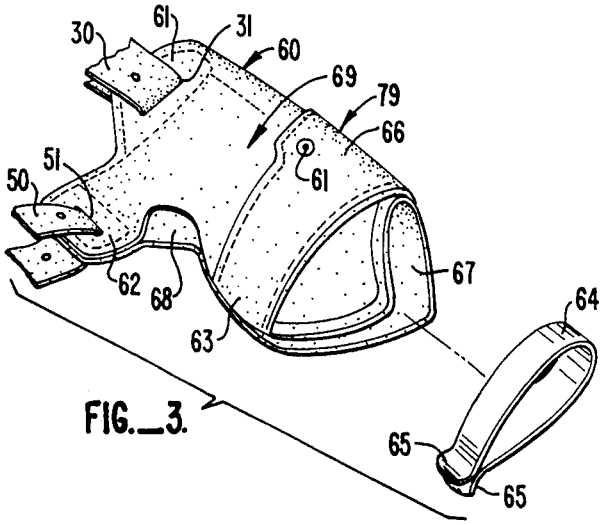
FIG. 3 is an exploded view of the sheath of the shoulder holster and its clip.

FIG. 3 is a detailed view of the gun sheath 60. The sheath is suspended from straps 30, 50 which pass through slots 31, 51 located at two spaced apart extensions 61, 62, respectively of the sheath. Sheath 60 may be formed of molded and stitched leather and is made to fit a certain model or type weapon. In this case, sheath 60 is designed to fit an automatic handgun. The sheath is symmetrical such that surface 69 is identical to the underside 79 of the sheath. Sheath 60 is reversed from one side of the shoulder holster to the other simply by removing straps 30, 50 from openings 31, 51, inverting sheath 60 and remounting it with straps 20, 40 passing through openings 31, 51 respectively from the other side of sheath 60 so that 79 is facing away from the torso.

Since sheath 60 is suspended from the straps 30, 50 in a vertical position, a strong spring clip 64, mounted to sheath 60, is used to safely secure the handgun 120 in sheath 60. Spring clip 64 is generally U-shaped with the free ends 65 formed to remain in close proximity when the spring clip is unstressed. Spring clip 64 is secured to sheath 60 by being captured between the outside of the sheath and a strip 63 sewn to the sheath.

Sheath 60 is sufficiently flexible and clip 64 is sufficiently strong so that spring clip 64 presses sheath 60 against the slide portion 125 of the handgun in the sheath. An adjustable tension screw 61 passes through sheath 60 to adjust the grip of spring clip 64 against a pistol. In the disclosed embodiment spring clip 64 is sized and positioned such that the free ends 65 engage the ejector port 103 found on automatic pistols. The remainder of spring clip 64 wraps around the slide 125 of the weapon when securing it within the sheath. The U-shape of the clip provides a proper grip, yet does not interfere with drawing the weapon. Depending on the weapon, various clips may be designed to provide the requisite biasing force of the sheath against the weapon to secure the weapon in place. The U-shaped spring clip 64 pressing on the outside of sheath 60 is particularly desirable because it provides a smooth surface against the weapon which does not catch or hang up on the weapon and therefore does not inhibit its draw from the sheath. If desired, sheath 60 can have cut outs formed adjacent free ends 65 to permit free ends 65 to directly contact the handgun.

To load the gun into sheath 60, the muzzle 100 of the gun is inserted through the opening 67 and pushed inwardly until spring clip 64 snap-engages the ejector port 103 of the gun. The butt 110, trigger and grip 101 of the gun hang upside down and remain exposed outside of the sheath. The holster is worn such that the sheath 60 is worn on the side opposite the wearer's shooting arm.

To draw the gun, the wearer grasps grip 101 of the gun and with a slight lateral tug, disengages the ejector port 103 from the spring clip 64. The gun is then naturally withdrawn downwardly from the sheath. The upside down position is clearly advantageous in situations where a fast draw is required. This position also places the thicker butt end 110 of the gun so that it lies flat against the lower chest area of the wearer. Under a jacket or coat, the holster and gun lie smooth and are less obvious than guns held with the butt end upwardly.

The entirety of the shoulder holster 10 is constructed from sheath 60, accessory carrier 70 and the four simple straps 20, 30, 40, 50 connected by the back piece 80. The straight straps are interchangeable and can suspend either sheath 60 or accessory carrier 70 to accommodate left-handed and right-handed wearers. The straps are provided with a series of holes and securing means such as a rivet or snap so that the length of the straps can be easily adjusted for the frame and comfort of the wearer.

The X-arrangement of the straps determined by back piece 80 is the key to the freedom of movement permitted by the holster. Back piece 80 is generally centered along the back of the wearer and rests between the shoulder blades. Armholes 90 are very roomy and do not bind the arms from rotational movement at the shoulder socket. The straps do not contact the underarm areas where perspiration can affect the holster leather, or cause discomfort. Because there are no straps which extend horizontally directly across the chest or back, the wearer can freely cross both arms in front of the body without restriction. Sheath 60 and accessory carrier 70 lie naturally against the sides of the torso and are weighted by gravity. Even while running, the holster remains stable.

Because of the simple construction and interchangeable nature of the elements of this shoulder holster, the shoulder holster is economical to manufacture. Assembly and adjustment are simple, and the elements can be constructed from durable leather.

The foregoing is a complete description of the invention, but is not intended to limit the scope of the invention, except as stated in the appended claims. While the above provides a full and complete disclosure of the preferred embodiments of the invention, various modifications, alternate constructions, and equivalents may be employed without departing from the true spirit and scope of the invention. For example, the accessory carrier shown in the figures could also be replaced by a second sheath for carrying another handgun. Further, the shoulder holster could be constructed in a single piece, combining the back piece and both pairs of straps into a single element. Therefore, the above description and illustrations should not be construed as limiting the scope of the invention which is defined by the appended claims.

What is claimed is:

1. A shoulder holster suitable for use with an automatic firearm, where the firearm includes a barrel, a side ejector port, a slide with said ejector port thereon and a grip, comprising:

a strap assembly for mounting said holster over a shoulder of a user;

a sheath mounted to said strap assembly, having a first, open end and an opposite second end, said sheath removably suspended from a first side of said strap assembly, said sheath sized and shaped to surround at least a portion of the firearm adjacent said slide; and a spring clip mounted to said sheath and which wraps around and is biased against the slide of the firearm to secure the firearm within said sheath, said spring having a portion thereof engageable with said ejector port to hold the firearm within said sheath.

2. The shoulder holster of claim 1, wherein said strap assembly comprises two pairs of straps defining a pair of armholes, and a back piece to which each said pair of straps is joined, said back piece arranging said pair of straps in an X-shape.

3. The shoulder holster of claim 1, wherein said strap assembly further comprises an accessory carrier suspended from a second side of said strap assembly beneath the other of said armholes.

4. The accessory carrier of claim 3, further comprising a pocket for ammunition clips.

5. The accessory carrier of claim 3, further comprising a strap, having a quick-release closure, said strap configured to removably secure handcuffs from said accessory carrier.

6. The shoulder holster of claim 1, wherein said sheath further comprises means for adjusting the biasing force of said spring clip against the slide of the firearm.

7. The shoulder holster of claim 6, wherein said adjusting means comprises a threaded tension screw.

8. The shoulder holster of claim 1, wherein said spring clip is generally U-shaped to wrap around the firearm, and further wherein the two free ends of said spring clip are formed and positioned to snap-engage the ejector port.

9. The shoulder holster of claim 3, wherein said accessory carrier is reversible to be worn on either side of said strap assembly.

10. A shoulder holster having a strap assembly suitable for carrying a handgun having a grip, a side ejector port, and a slide with said ejector port thereon, comprising:

a sheath having a first, open end and a second end, said sheath mounted to said strap assembly at said second end, said sheath shaped to house at least a portion of the handgun, said sheath having symmetry along either side; and a spring clip mounted to said sheath which is generally U-shaped to wrap around and bias against the slide of said handgun, said spring clip having two free arms at a first end, said free arms biasing the sheath against the ejector port of the handgun from opposite sides of the slide.

11. The shoulder holster of claim 10, wherein said sheath further comprises means for adjusting the biasing force of said spring clip against the slide of the handgun.

* * * * *